US005343822A

United States Patent [19]

Husain

[11] Patent Number: 5,343,822

[45] **Date of Patent: * Sep. 6, 1994**

[54] EMERGENCY TRANSFER OF OIL FROM A RUPTURED SHIP'S TANK TO A RECEIVING VESSEL OR CONTAINER, PARTICULARLY DURING THE MAINTENANCE OF AN UNDERPRESSURE IN THE TANK

[76] Inventor: Mo Husain, 908 Stratford Ct., Del Mar, Calif. 92014

[ * ] Notice: The portion of the term of this patent subsequent to Mar. 3, 2010 has been disclaimed.

[21] Appl. No.: 844,140

[22] Filed: Mar. 2, 1992

Related U.S. Application Data

[63] Continuation-in-part of Ser. No. 377,886, Jul. 10, 1989, Pat. No. 5,156,109, and Ser. No. 503,712, Apr. 3, 1990, Pat. No. 5,092,259.

[51] Int. Cl.[5] ..... B63B 25/08

[52] U.S. Cl. ..... 114/74 R; 114/72

[58] Field of Search ..... 114/65 R, 74 A, 74T, 114/74 R, 72; 220/1 B, 5 A, 1 V, 855, 85 VR, 85 VS, 900

[56] References Cited

U.S. PATENT DOCUMENTS 5,086,722 2/1992 Sloope et al. ..... 114/74 R
5,092,259 3/1992 Husain ..... 114/74 R

*Primary Examiner*—Ed Swinehart
*Attorney, Agent, or Firm*—William C. Fuess

[57] ABSTRACT

A system and method to transfer oil cargo from ruptured tank(s) of a tanker to receiving vessel(s) or receiving tank(s), while maintaining a partial vacuum in the ullage space of the ruptured tank(s). A partial vacuum is created and maintained in the ullage space of tank(s) of a tanker to reduce outflow of liquid such as oil in the event of a ruptured tank. The vacuum is continuously maintained in a precise balance responsive to the forces acting on the contents of the tank, which forces change when the tank is ruptured. According to the preferred embodiment of the invention the liquid cargo in the tank(s) of the ruptured vessel is transferred to tank(s) of receiving vessels or any designated receiving tank(s) while maintaining the partial vacuum in the ullage space of the tanks of the ruptured tanker or vessel. The partial vacuum in the ullage space of the ruptured tank must be maintained while the oil is transferred to tanks of a receiving vessel, otherwise catastrophic oil spillage may occur.

18 Claims, 6 Drawing Sheets

Pump Requirements

Suction pressure at entry to pump:

Consider total energy at Sections Z and S $$\frac{P_U}{P} + H_A + \frac{V_Z^2}{2g} = \frac{P_S}{D} + (H_A + H_B) + \frac{V_S^2}{2g} + \text{Losses}$$

Where: P = pressure, D = oil density, V = velocity, and H = height.

Losses = entry losses into duct + friction losses + pipe turns $\frac{P_S}{D} = H_B$ + Losses , assumes constant diameter duct $V_Z = V_S$ Pump Discharge Pressure $$= P_{atmosphere} + \frac{D.V_X^2}{2g}$$

Pump Pressure Rise - $\Delta P$ $$= P_{atmosphere} + \frac{D.V_X^2}{2g} - [H_B D + \text{Losses}]$$

Power Requirement (HP) = $\frac{Q x \Delta P x 144}{33x10^3 x \eta}$

Where: Q = flow in cubic feet per minute (CFM), $\eta$ = efficiency, and $\Delta P$ = pounds per square inch (psi)

Case Assumptions:

Cargo tank capacity = $1x10^6$ gallons [$1.34x10^5$ cubic feet]
Duct diameter = 1 foot
$H_B$ (Height) = 10 feet Losses = entry losses into duct + friction losses + pipe turns $$= \frac{1}{2} x \frac{D.V^2}{2g} + \text{insignificant FL} + 3x90^\circ \text{ turns} + 3 x \frac{D.V^2}{2g}$$

$$= 3\frac{1}{2} x \frac{D.V^2}{2g}$$

FIG. 5A $$\text{Pump Net Pressure Rise } (\Delta P) = P_{atmosphere} + \frac{D.V^2}{2g} - \left[D H_B + 3\frac{1}{2} \times \frac{D.V^2}{2g}\right]$$

$$= P_{atmosphere} - \left[D H_B + 2\frac{1}{2}\frac{D.V^2}{2g}\right]$$

Flow in CFM (Q) = Tank Capacity/ (Transfer Time)

$$= \frac{1.34 \times 10^5}{t \times 60} \text{ where } t = \text{Transfer Time (hours)}$$

Duct Velocity in feet per second (V) = CFM/Duct Area/60

$$\text{Dynamic Head in pounds per square inch } (q) = \frac{D.V^2}{2g} = \frac{58 \times V^2}{2g \times 144}$$

$$\text{Potential Head Pressure} = \frac{D H_B^2}{144} \approx \frac{58 \times 10}{144} \approx 4 \text{ pounds per square inch (psi)}$$

$$\text{Pump Pressure Rise - } \Delta P = 14.7 - \left[4 + 2\frac{1}{2} q\right]$$

| Transfer Time (hours) | CFM (Q) | V (ft/sec) | q (psi) | ΔP (psi) | HP |
|---|---|---|---|---|---|
| 12. | $1.86 \times 10^2$ | 3.9 | $9.5 \times 10^{-2}$ | 10.46 | 14. |
| 14. | $0.93 \times 10^2$ | 1.97 | $2.4 \times 10^{-2}$ | 10.46 | 7.2 |
| 36. | $0.62 \times 10^2$ | 1.3 | $1.06 \times 10^{-2}$ | 10.67 | 4.8 |

FIG. 5B

EMERGENCY TRANSFER OF OIL FROM A RUPTURED SHIP'S TANK TO A RECEIVING VESSEL OR CONTAINER, PARTICULARLY DURING THE MAINTENANCE OF AN UNDERPRESSURE IN THE TANK

REFERENCE TO RELATED APPLICATIONS

The present application is a continuation-in-part of U.S. patent application Ser. No. 377,886 filed Jul. 10, 1989 for a SYSTEM TO REDUCE SPILLAGE OF OIL DUE TO RUPTURE OF A SHIP'S TANK, issued as U.S. Pat. No. 5,156,109 and U.S. patent application Ser. No. 503,712 filed Apr. 3, 1990, for INERT GAS CONTROL IN A SYSTEM TO REDUCE SPILLAGE OF OIL DUE TO RUPTURE OF A SHIP'S TANK issued as U.S. Pat. No. 5,092,259, which predecessor applications are to the same inventor as the present application. The contents of the predecessor patent applications are incorporated herein by reference.

BACKGROUND OF THE INVENTION

1. Field of the Invention

The present invention concerns the transfer of a liquid, nominally oil, from the ruptured tank(s) of a first ship, which may be an oil tanker or a vessel of any type, to the tank(s) of a second, receiving, vessel, and/or to tank(s) upon the shore, while constantly, and also dynamically, maintaining a partial vacuum in the ullage space of the ruptured tank(s) during the transfer, thereby to minimize spillage though the rupture(s) even as the oil is being transferred. The present invention further concerns the plumbing of a ship's tank containing liquid, nominally oil, in order to facilitate both a normal, and any emergency, evacuation of the liquid contents of the tank, including any emergency evacuation of the partial liquid contents remaining in a ruptured tank.

2. Background of the Invention

With the advent of supertankers, a single oil spill incident can (i) cause significant damage to the environment, (i) disrupt the ecological balance, and (i) cause substantial economic loss. The accident of EXXON VALDEZ is perhaps the worst oil spillage disaster in U.S. history. The EXXON VALDEZ leaked about 240,000 barrels—over 10 million gallons of oil. The economic and environmental cost is estimated to have been over two billion dollars.

When a tank containing liquid, nominally oil, of a ship is ruptured then it is imperative that any remaining liquid within the ruptured tank should be transferred to a secure, unruptured, tank on the same or on another ship, or on shore, as soon as is possible. By doing so, any remaining, unspilled, contents of the ruptured tank are less likely to escape, and to add to any volume of escaped liquids that may already be contaminating the environment. It is always eventually necessary to transfer the oil or other liquid from a ruptured tank even if such liquid is substantially, or totally, retained within the ruptured tank because the rupture must ultimately be patched or repaired, including by dry-docking the ship.

2.1 Related Background to the Present Invention

The predecessor, related, patent applications to the present application teach related inventions for reducing or forsteming any outflow of liquid, such as oil, due to the rupture of a ship's tank. The system, and method, of the related inventions involve the creation, and the subsequent dynamic maintenance, of a partial vacuum in the effected tank or tanks. A partial vacuum below atmospheric pressure is preferably, and initially, created in the ship's tank before any rupture has occurred, and normally after filling of the tank and before disembarkation of the ship. Thereafter the partial vacuum is continuously dynamically maintained in a precise balance responsive to the forces acting on the liquid contents of the tank, which forces change when the tank is ruptured. The dynamically maintained partial vacuum serves to hold the liquid contents of the tank within the tank even if, and when, the tank is ruptured—much in the manner that liquid is held within an inverted glass when the glass is pulled above the liquid level of a reservoir.

If the rupture is below the water line, and on the side of the ship's hull, then surface tension dynamics at the rupture between the tank's interior liquid, nominally oil, and the exterior water will induce a stratified flow, forcing water into the tank through the lower part of the rupture while forcing the liquid oil upward and out of the tank, oppositely to the flow of water. This stratified flow will continue until the water level reaches the top part of the rupture.

In one, preferred, embodiment of the related inventions this stratified flow is stopped because a non-structural barrier, typically a tarpaulin, is placed over the rupture. The barrier is placed over the rupture even as, and while, the partial vacuum is dynamically maintained. The combination of dynamic underpressure control and the non-structural barrier substantially forestalls oil outflow—even below the level of the rupture.

The predecessor, related, patent applications to the present application also teach the maintenance of an inert gas mixture in the ullage spaces above a combustible and vaporizable liquid, nominally oil, in a ship's tank in order to prevent any explosion or combustion. The gas mixture is maintained sufficiently inert so as to prevent combustion even while, and during, the constant, and dynamic, simultaneous maintenance of an underpressure within the tank.

Accordingly, the related applications teach how to substantially contain a liquid, nominally oil, in a ruptured tank—at least temporarily. Once a ship's tank is ruptured, however, its oil, or other liquid, contents must ultimately be transferred to the tank(s) of another vessel, or to other undamaged tanks. The preferred embodiment of the present invention will be seen to accomplish this necessary transfer of oil—while still containing substantially all untransferred oil in the tank(s) of the ruptured tanker or vessel by a simultaneous continuing, and dynamic, maintenance of an underpressure in the ruptured tank(s). This underpressure will be sufficient so as to at all times substantially prevent spillage from the tank through its rupture(s)—even though oil is otherwise, and elsewhere, being intentionally extracted from the ruptured tank(s).

The present invention will thus be seen to deal with the problem, roughly stated, of how to hold oil in a ruptured ship's tank at one outlet from the tank—the rupture—while simultaneously extracting oil from the tank at another outlet—an outlet by which oil may be extracted to an undamaged tank.

Two considerable challenges are presented. First, any interruption in the dynamic maintenance of a partial vacuum in the ullage space of the ruptured tank, even while its oil is being transferred to a safer reservoir, may permit a catastrophic oil spill to occur, or to increase.

Second, to a dynamic underpressure control system (in accordance with the related patent applications) that is trying to hold oil within a ruptured tank, any attempted intentional extraction of oil from the tank appears very much the same as an inadvertent, unintentional, and undesired spillage from the tank.

Interestingly, this second challenge in handling of the liquid, oil, contents of the tank may be compared to the challenge of inerting the gaseous mixture in the ullage space of the tank. This later challenge is met by the system of the aforementioned U.S. patent application Ser. No. 503,712 filed Apr. 3, 1990, for INERT GAS CONTROL IN A SYSTEM TO REDUCE SPILLAGE OF OIL DUE TO RUPTURE OF A SHIP'S TANK.

In the inert gas control system of the predecessor invention the gaseous mixture within the ullage space of a ship's tank must be rendered, and maintained, inert to combustion by putting something, namely inert gas, into the ullage space. This must transpire simultaneously that something else, namely the mixture of inert gases, is being removed from the ullage space in order to create the desired underpressure condition therein. Roughly speaking, two systems and processes must act in opposition to each other in a manner that permits each to accomplish its desired function.

In the system of the present invention the liquid contents of the tank must be removed at a desired outlet from the tank—the mouth of an extraction pipe—simultaneously that the same liquid contents of the tank are precluded, by dynamic underpressure control, from exiting the tank at another outlet to the tank—its rupture. It will subsequently be seen that, in accordance with the present invention, two systems and processes will act upon the liquid contents of the ruptured tank, at least locally at the mouth of the extraction pipe, in opposition to each other. However, because of a relationship that will be seen to be established and maintained between the hydrostatic forces generated, at least locally at the mouth of the extraction pipe, by the two counteracting systems, both systems will be seen to be simultaneously functionally operative for their separate, but related, purposes: holding the oil in the tank at the location of the rupture while extracting the oil at the location of the extraction pipe.

Without immediately explaining the invention, which is directly hereinafter set forth, it might well be considered that several specific questions and challenges would likely have to be addressed, and successfully met, by a system and a method that would permit the selective offloading of oil from a ruptured tank.

First, it would seemingly be important to know exactly where, and/or at what times, oil should be removed (by pumping) from the ruptured tank(s). (In fact, it will prove less critical to know the time(s) of removal.)

Second, the conduits, or pipes, by which the oil is to be removed must be identified. It would seemingly prove useful if the removal conduits were to be, at least in substantial portion, the selfsame existing conduits that are used to fill and/or empty the tank(s).

Third, there must seemingly be some relationship between the negative pressure (suction) forces of the (ullage space underpressure control) system that is attempting to hold oil in the tank(s) versus the like negative pressure forces of the (pumping?) system that is attempting to extract oil from the tank(s). It seems clear that the suction forces of the extraction system must be at least somewhere, and at least regionally, stronger. However, it is not immediately clear where this region, or these regions, are. It is also not clear how much stronger the suction forces of the extraction system should be than the like forces of the retention system.

Finally, there would seemingly be a severe challenge, which will be seen to be successfully met by the present invention, in priming with oil any pump of an extraction system so using a pump when such priming is itself hydrodynamically akin to a spill, meaning that it involves migration Of oil into regions that it does not normally go while resident in an unruptured tank.

2.1 Specific Previous Systems for Emergency Extraction of Ship-borne Liquids, Particularly Oil Although the best previous systems known to the inventor for the offloading of liquids, nominally oil, from the a ruptured tank(s) of a ship is not deemed to be particularly relevant to the present invention, an overview of such previous systems is useful for understanding the considerable problems faced in evacuating oil from a ruptured tank, and previous approaches to the problems.

U.S. Pat. No. 4,960,347 to Strange for a SHIP-BORNE EMERGENCY OIL CONTAINMENT SYSTEM AND METHOD describes the evolution of a spill of a liquid, nominally oil, from a ruptured ship's tank containing liquid. The SYSTEM contemplates a normally-empty emergency holding tank on the ship. After rupture, a ruptured tank is externally enshrouded by a flexible barrier curtain in order to entrap, at least partially, whatever liquid cargo may have leaked from the ruptured tank. Meanwhile, a water-tight seal is formed at the top of the ruptured tank about an inserted suction intake. The remaining liquid contents of the ruptured tank is pumped through the suction intake to the emergency holding tank until the ruptured tank becomes water-filled to at least the top of the rupture.

The SYSTEM of Strange depends on special equipments—an emergency holding tank of considerable capacity and a flexible barrier curtain—and on a quick response after the occurrence of a rupture. The reason that the emergency holding tank must be on the same ship that incurs the rupture is to permit transfer of oil from a ruptured tank(s) before other support resource could reasonably be expected to arrive. The system and method in accordance with the present invention will be seen (i) to require much less extensive special equipment(s), (ii) to be automatically operative at the time of rupture (and before), and (iii) to be tolerant of such unavoidable delays as will permit other ships into which oil from the ruptured tank(s) will be offloaded to arrive.

Although the workable solution of the present invention will be seen to be straightforward, that such a solution is not obvious may be gauged by the aforementioned Swedish system for which a compatible oil-extraction pumping system has reportedly long been sought.

SUMMARY OF THE INVENTION

The present invention contemplates a system, and a method, for (i) maintaining a gaseous underpressure in the ullage space of a ruptured ship's tank containing liquid in order to inhibit spillage of the liquid through the rupture, while simultaneously (ii) evacuating, through a pipe that flow-connects selectively to the liquid contents of the ruptured ship's tank, the unspilled liquid contents of the ruptured tank.

In its most rudimentary embodiment the system of the present invention includes an underpressure means for dynamically maintaining an underpressure less than atmospheric pressure in an ullage space of a ruptured tank of a ship. The dynamically maintained underpressure produce a balance in all forces acting on liquid contents of the ruptured tank. This balance of forces tends to preclude that the liquid contents of the tank should egress through any incipient rupture, or, for that matter, through anyplace else such as through the standard fill pipe(s) of the tank.

The rudimentary embodiment of the system of the present invention further includes a special evacuation conduit, or pipe. The evacuation pipe presents an inlet, or mouth, that may be selectively and variably ported to any level within the tank—thereby to be flow-connectable to any remaining, unspilled, liquid contents of a ruptured tank such as exist at any level within the tank. Such a selective, and selectively variable, flow-connection specifically means that the evacuation pipe's mouth is never opened (i) to the ullage space of the ruptured tank, nor (ii) to any water that may have entered into the tank and that resides at the tank's bottom. This is the case regardless that both the ullage and the water levels and volumes may each vary during both (i) the evolution of the rupture and (ii) the course of the off-loading of the remaining liquid contents of the tank, and or any or all the remaining cargo (whether liquid cargo or not, of from ruptured tanks or not) of the ship.

The selectively variably flow-connectable evacuation pipe is preferably a dedicated vertical standpipe located within the tank and having a multiplicity of selectively controllable valves along its length. Each valve may be selectively opened to flow-connect the evacuation pipe to such liquid (or gas) as is present at a certain height within the tank. The evacuation pipe may, alternatively, be integral with the, or one of the, main fill pipe(s) of the tank. However, the evacuation pipe is preferably a unique, separate, pipe that is typically of lessor, and more typically of much lessor, diameter than is (are) the standard fill pipe(s) of the tank.

Finally, the rudimentary embodiment of the system of the present invention includes a liquid evacuation pump that is connected to the evacuation pipe. The evacuation pump may be a, or the, main ship's pump(s) that are used for normal offloading of the liquid contents of the tank(s). However, the evacuation pump is preferably a separate pump, typically smaller and potentially (with the diameter of the evacuation pipe and the depth of the tank) much smaller than a main pump, that feeds liquid pumped from a ruptured tank into a, or into the, main ship's tank(s) pump(s). During the time that the evacuation pipe, and the evacuation pump, are so used the main fill pipe(s) of the ruptured and unruptured tanks are shut off by action of a valve(s). These fill pipe(s) valves may be considered part of the system of the present invention, but are normally already present. When a separate evacuation pump is used then it is preferably flow-connected to one or more of the ship's main pumps, and operates in concert with such main pump(s) to pump liquid from the ruptured tank.

In operation of the system of the present invention, a gaseous underpressure less than atmospheric pressure is maintained, and dynamically maintained, within the ullage space of the ruptured tank. The underpressure produces a balance of the forces acting upon the liquid within the tank, tending to preclude that the liquid contents of the tank should spill through a rupture to the tank.

Meanwhile to the maintenance of the underpressure, both the evacuation pump and the main pump(s) acting in combination (although the evacuation pump may act alone) produce a hydrostatic suction force at the mouth of the evacuation pipe that is stronger than the underpressure. Because the suction force locally at the evacuation pipe's mouth is regionally stronger than the underpressure force acting upon the entire body of liquid within the tank, the liquid contents of the tank will be evacuated through the evacuation pipe—regardless that the underpressure works against this flow.

During evacuation of the ruptured tank, the system and method of the present invention permits the selective recovery of a remaining, unspilled, substantially-original portion of the liquid contents of the tank. Remaining contents of the tank, principally water contaminated to a greater or lessor degree, may also be selectively progressively recovered if, when, and to such extent as is desired.

The system and method of the present invention so operate because, after rupture, the original liquid contents of the tank will typically substantially stabilize at some level dependent upon the height of the tank's rupture and/or the efficacy of the underpressure spill avoidance system. Normally, the original liquid contents of the tank, typically oil, will end up floating on top of water that has entered into the tank up to a level equal to the top of the rupture. (If the tank's rupture is at its bottom, as is common, only a modest amount of oil may have spilled.)

In order that substantially all this remaining liquid (only) should be evacuated from the tank, while, if so desired, only an insubstantial amount of such seawater as may have entered and as may continue to enter the ruptured tank should be evacuated, the depth of the mouth of the evacuation pipe within the ruptured tank is adjustable. Normally the mouth of the evacuation pipe is dynamically adjusted, at least sporadically, during the progress of the evacuation. The physical evacuation pipe is preferably not moved: rather, the arrayed valves along a single evacuation pipe that vertically extends the entire depth of the ruptured tank are selectively opened to the contents of the tank. Valves are successively opened in the evacuation pipe at one or more positions that are (i) below the surface of the remaining liquid, but (ii) above, and usually well above, the level of water within the tank.

The liquid contents of the tank are then evacuated by pumping. If, due to the progress of offloading, the draft of the ship in the surrounding water varies, or threatens to vary, so greatly so as to move, or so as to threaten to move, a valve opening which was originally below the surface of the liquid to a new position above the surface of the remaining liquid, then it is a straightforward matter to change valve openings to a next most suitable evacuation point. Various sequences, and progressions, of the opened valves are possible. Certain bottom-up valve-opening progressions evacuate relatively more water but are more effective in reducing any concomitant pollution external to the tank. Meanwhile other, top-down, progressions of valve openings are relatively more effective in offloading, at least initially, pure liquid cargo that is uncontaminated, or unsubstantially contaminated, by water.

The preferred system and method of the present invention still further preferably permits use of, and cooperative operation with, the existing plumbing and pumping of the ship's tank. By this use of existing structure the system of the present invention for accomplishing the evacuation of the unspilled contents of a ruptured ship's tank is economical in cost.

For a more complete understanding of the invention, and of the further objects and benefits thereof, reference is now made to the accompanying drawings referred to as FIGURES, which drawings include a mechanical schematic diagram of preferred embodiment of the system, and also a mechanical schematic diagram of a ruptured tanker transferring its oil cargo to a receiving vessel.

BRIEF DESCRIPTION OF THE DRAWINGS

FIG. 5, consisting of FIG. 5*a* and FIG. 5*b*, shows the calculation of the pump horsepower of the emergency transfer system in accordance with the present invention.

DESCRIPTION OF THE PREFERRED EMBODIMENT

The system and method of the present invention accords for the emergency transfer of liquid, typically oil and more typically oil cargo, from a ruptured tanker or other vessel to tank(s) of receiving vessel or other designated tank(s) while, and simultaneously that, the ullage space(s) of the ruptured tank(s) of the tanker or vessel is (are) maintained in a partial vacuum state, thereby to prevent oil spillage through the rupture(s) of the tank(s).

Figure 1:
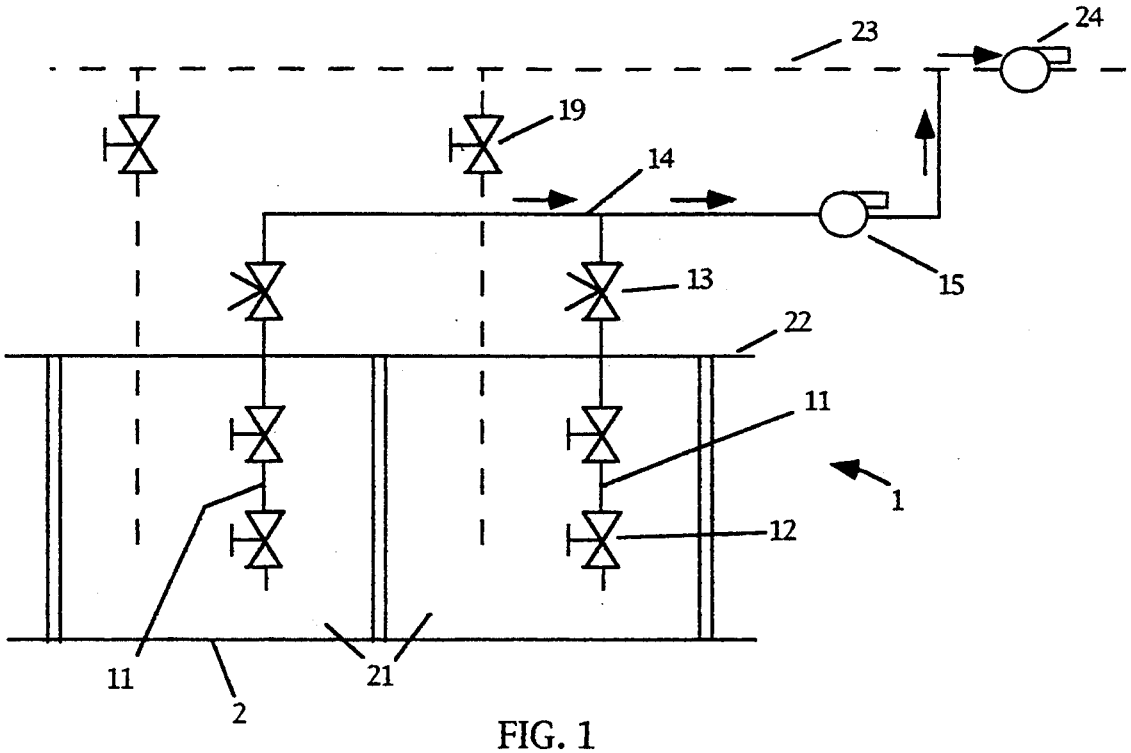
FIG. 1 is a mechanical schematic diagram of preferred embodiment of the emergency transfer system in accordance with the present invention.

The preferred embodiment of an emergency transfer system 1 in accordance with the present invention is shown in a mechanical schematic diagram in FIG. 1. The system 1 includes an evacuation conduit, or pipe 11 in each of the tank(s) 21 of a ship 2 (the tanks and ship are not part of the system). The evacuation conduit has multiple openings at different levels each with a remotely operated valve, and with an isolation valve 13 above the deck 22 of ship 2. The evacuation pipes 11 are connected to a transfer duct 14, which may be considered but an extension of the evacuation pipes 11. The transfer duct 14 is flow-connected to an evacuation suction pump 15. The outflow from evacuation pump 15 is typically flow-connected to existing ship's main discharge duct 23 which is flow-connected to existing ship's main discharge pump(s) 24.

The evacuation pipe is preferably a relatively small diameter separate pipe, normally conventional in type but having a unique purpose, that vertically extends the entire depth of the tank. It is possible to adapt one or more of the tank's main fill pipes, which are typically of large diameter, to serve as the evacuation pipe—but this is not preferred. The purpose of installing the multiple valved openings in the evacuation pipe 11 is to permit selective controlled connection of the evacuation pipe's intake, or mouth, to the lowest level of the contents of the ruptured tank that have not been replaced with, or (as desired) contaminated by, water incoming through the tank's rupture 211 (shown in FIG. 2).

In operation to evacuate liquid, normally oil, selectively from the tank or tanks 21, typically at a time after the rupture of such tank(s), the system of present invention creates by operation of evacuation pump 15 a greater negative pressure in the transfer duct 14 and in those evacuation pipes 11 that are opened to the contents of tank(s) 12 by valve(s) 13 than that negative pressure that exists in the ullage space of the ruptured tank(s) 21 of the ship 2. The greater negative pressure in the evacuation pipe(s) 11 and transfer duct 14 starts a flow of oil 3 from the tank(s) 21 and delivers this oil 3 to the existing main discharge pump(s) 24 via existing discharge duct(s) 23. .Once an initial flow of oil 3 is delivered to the existing main discharge pump(s) 24, it serves to prime the pump(s) 24.

Figure 2:
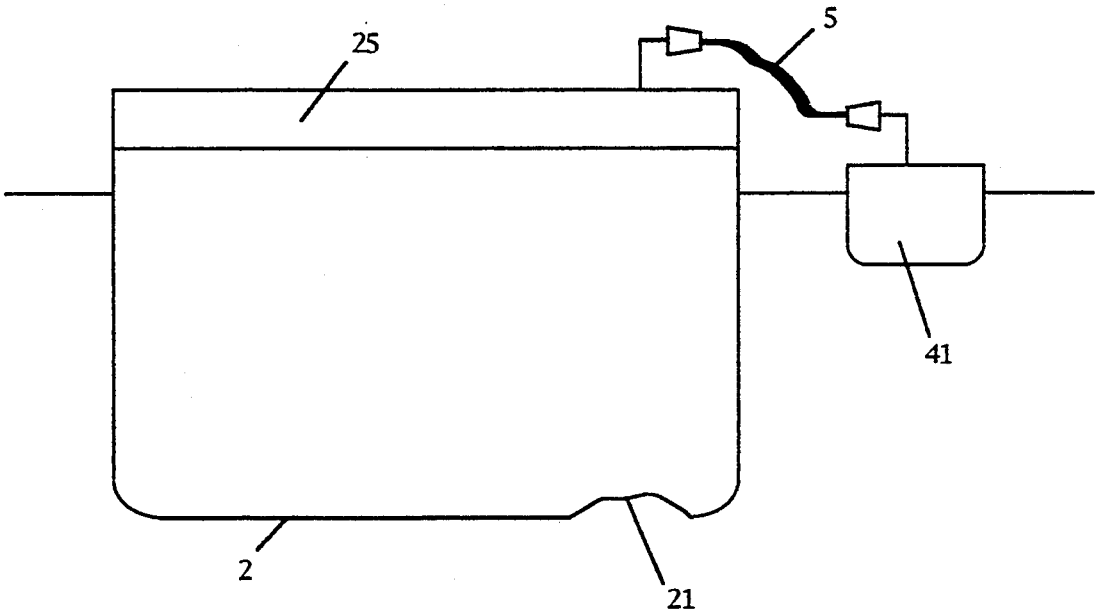
FIG. 2 is a diagrammatic view of the emergency transfer system in accordance with the present invention in use for transferring the liquid contents of a ship's ruptured tank to a receiving vessel.

The simultaneous, ganged, series operation of both the evacuation pump(s) 15 and the main ship's discharge pump(s) 24 facilitates the pumped discharge of oil 3 from the ruptured tank(s) 21 of the ship 2 to one or more tank(s) 41 of a receiving vessel 4, as diagrammed in FIG. 2. The transfer typically transpires via a flexible hose 5.

The operation of the system 1 of the present invention to transfer liquid, nominally oil, is without breaking the partial vacuum that is continuously, and dynamically, maintained in the ullage space(s) 25 (shown in FIG. 1) of the ruptured tank(s) 21 (shown in FIG. 1) of the ship 2.

Figure 3:
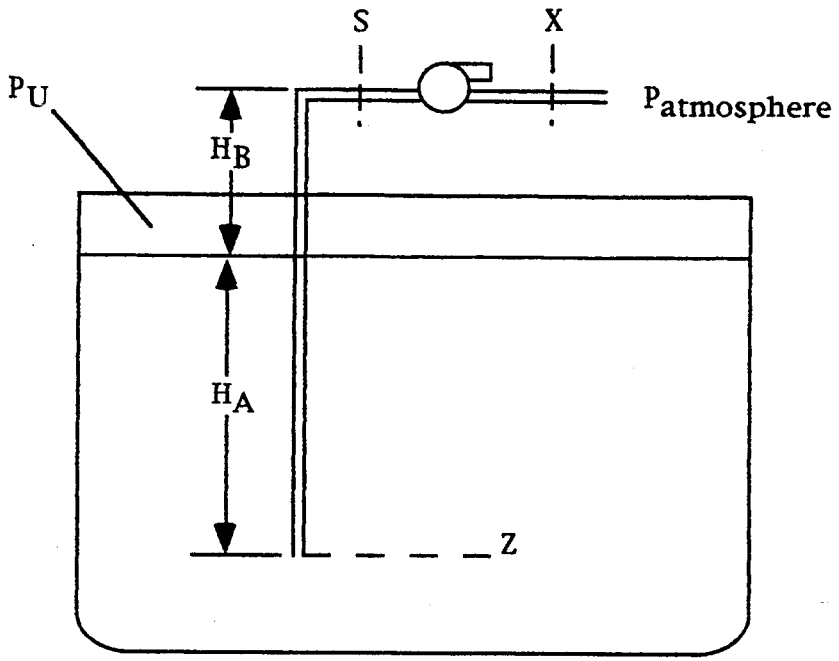
FIG. 3 is a schematic diagram showing parameters useful for calculation of the required evacuation pump horsepower in the emergency transfer system in accordance with the present invention.
Figure 4:
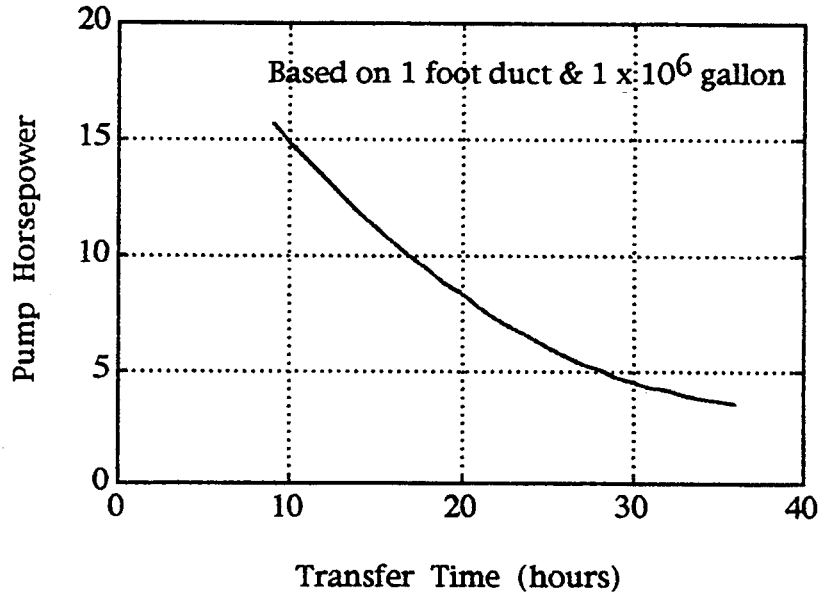
FIG. 4 is a graphic plot showing pump horsepower versus transfer time in hours for the preferred embodiment of the emergency transfer system in accordance with the present invention.
Figure 6:
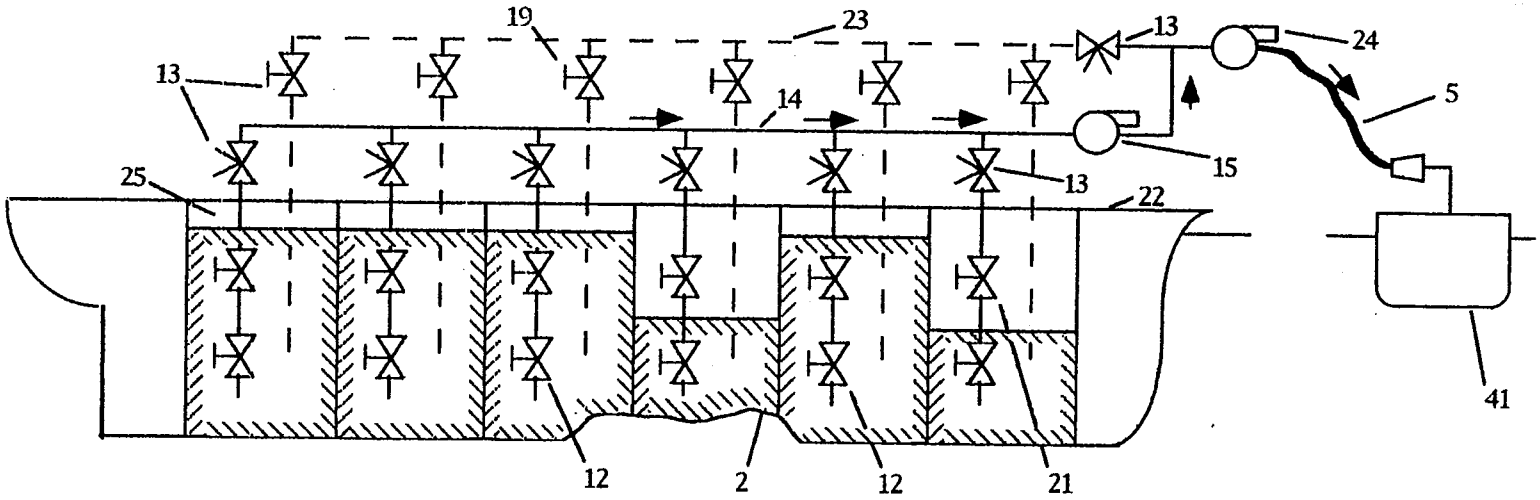
FIG. 6 is a profile schematic diagram of preferred embodiment of the emergency transfer system in accordance with the present invention.
Figure 7:
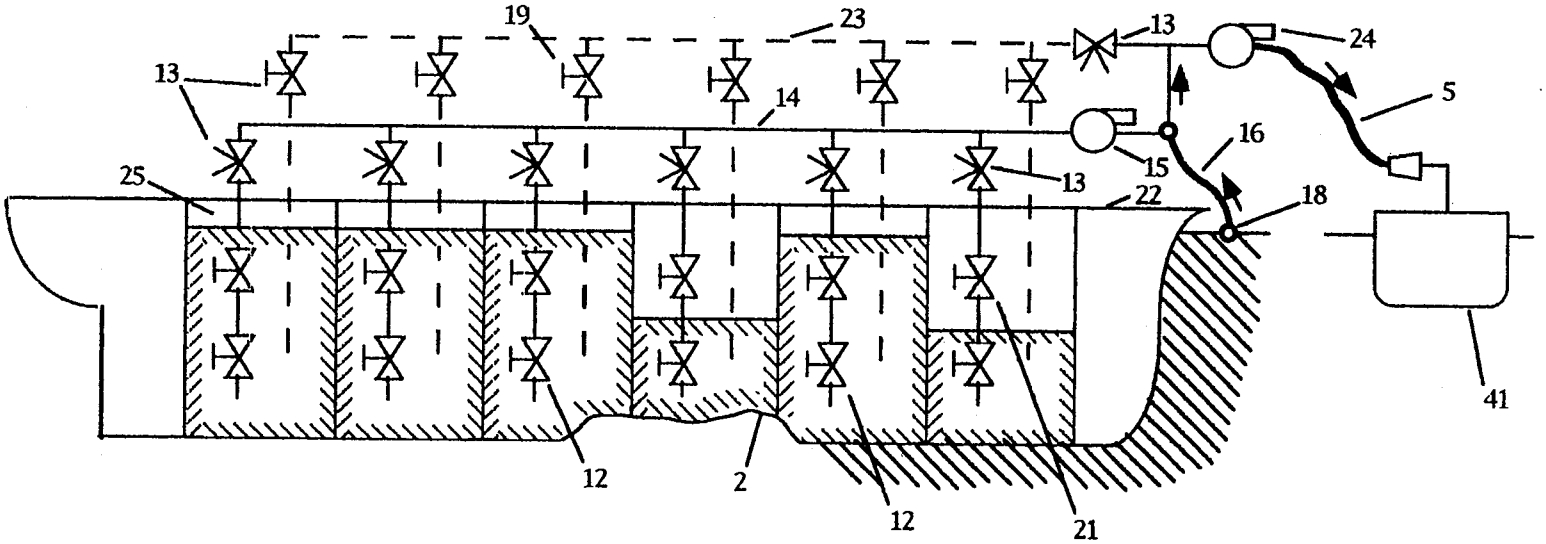
FIG. 7 is a profile schematic diagram of the preferred embodiment of the emergency transfer system in auxiliary use of the system to vacuum spilled oil from outside the hull of a ship.

It is possible to calculate the horsepower required by the evacuation suction pump 15. FIG. 3 is a mechanical schematic diagram of showing pertinent parameters of the emergency transfer system 1 used in this calculation of required pump horsepower, and FIG. 4 is a graphic plot showing a range of evacuation pump horsepower versus the transfer time in hours of one million gallons of liquid ($1\times10_6$ gallons) through a transfer duct 14 of one foot diameter.

Figure 8:
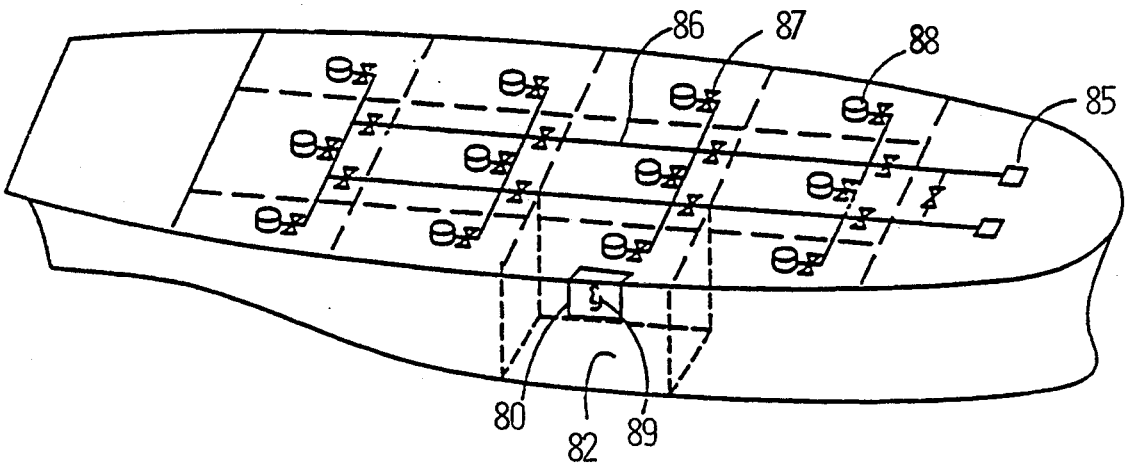
FIGS. 8 and 9 show a schematic arrangement of the underpressure system, with which system the emergency transfer system of the present invention is cooperatively operative, in an oil tanker.
Figure 9:
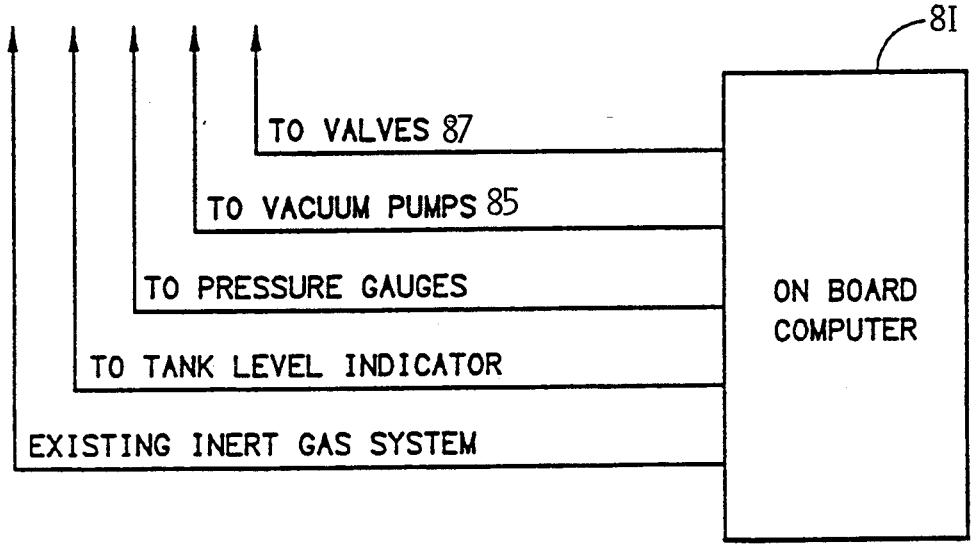

The underpressure system with which the emergency transfer system of the present invention is cooperatively operative is comprised of devices such as vacuum pumps 85, ducts 86, valves 87, electronic sensors, computer 81 and a flexible barrier similar to tarpaulin 80 or a rigid barrier or a chemical barrier (all shown in FIG. 8). The devices such as vacuum pumps 85 are connected to the tank 82 or tanks by ducts 86. The device such as vacuum pump 85 or pumps are controlled by computer 11 (shown in FIG. 9) with manual override in case of failure of the computer system.

The partial vacuum condition in the ruptured tanks will be maintained continuously by pumping out air from the ruptured tanks by means of vacuum pumps 85 which are connected to the tank or tanks by ducting 86, and is controlled by means of valves 87 and by computer 81.

According to the preceding explanation, it will be recognized that a principal object of the present invention is to provide an economical and low cost system for transferring a cargo of liquid, nominally oil, from the ruptured tank(s) of a ship, including a tanker ship, or other vessel simultaneously that a loss of liquid, or oil, through the rupture(s) is substantially prevented. The preferred system can be retrofitted to existing vessels.

The system and method of the invention operates to (i) transfer oil or liquids from the ruptured tank of a vessel to another receiving vessel or tank(s) while (ii) preventing spillage through the rupture(s) by continuously maintaining a partial vacuum in the ullage space of the ruptured tank(s). The (ii) prevention of spillage is achieved by a constant retention and dynamic maintenance of a partial vacuum in the ullage space—even while the oil is being transferred to another safe vessel or tank(s). The (ii) transfer is achieved, at least in part, through a special evacuation pipe(s). The evacuation pipe(s) is (are) notable for flow-connecting only to the liquid within the ruptured tank(s) that is desired to be transferred. The (ii) transfer is further under force of a special evacuation pump. This pump is notable for producing a suction in the evacuation pipe(s), and on the liquid contents of the ruptured tanks at the inlet to such pipe, which is greater than the negative pressure force of the partial vacuum.

The system of the present invention eliminates the need for expensive and/or portable special equipments. Crucial time delay in obtaining or using such equipments is substantially avoided. The system of the present invention permits the timely, cost-effective, and environmentally sound salvage of both the liquid cargo and the hull of a vessel having one or more ruptured tanks without appreciable risk of substantial additional oil spillage resultant from the salvage operation or attempt.

Also in accordance with the preceding explanation, the objects of the present invention have been seen to be achieved in and by means of a system that preferably includes (i) an evacuation pipe to a ship's tank, which evacuation pipe is selectively opened at various levels within the tank, that is flow-connected to (ii) an evacuation pump, that is flow-connected to (iii) a main fill pipe, or standpipe, to the tank which fill pipe is, in turn, blocked at its normal flow-connection to the tank while remaining flow-connected to the (iv) the main ship's pump(s), which main pumps evacuate pumped liquid through the ship's (v) normal main discharge ducts. The system (i) creates a greater negative pressure than in the ullage space i.e. suction pressure in the intake and transfer duct and, (ii) thereby delivering a flow of oil from the ruptured tank to the main discharge pumps through the intake and transfer duct for activation of the main discharge pumps.

The suction pressure in the intake and transfer ducts are created by pump(s). The intake duct in the tank(s) typically has two or three intake openings with remote operated valves. The terminal ends of discharge ducts are fitted with flexible hose(s) for a final unloading of oil cargo in the tanks of receiving vessels or tanks.

The preferred system of the invention accords for transfer of oil cargo from a ruptured vessel while the ullage space of the tanks of the vessel is maintained with partial vacuum in order to prevent spillage of oil from accidental rupture of tank(s).

After rupture of the tank and such interchange of the liquid within the tank and the outside water as is not prevented by the dynamic underpressure control system, the remaining liquid, nominally oil, contents of the tank will be floating at a height within the tank which is above the highest point of the rupture.

A further application of the emergency transfer system is that the emergency transfer system can also be used to suck up any oil that floats up in the near vicinity of the hull. The suction pump of the emergency transfer system 15 is connected to a flexible hose 16. The end point of the flexible hose 16 is connected to a floatation device (not claimed in this patent application) such as conventional oil skimming booms.

The surface oil 18 spilled outside and along side the ruptured hull 2, is sucked up by the suction pump 15, and primes the main discharge line 23. Main discharge pump 24 draws the surface oil 18 (in all probability mixed with water) from the ocean surface and discharges to the receiving vessel 41, via flexible hose 5.

While the preferred embodiment of the invention has been disclosed, modifications can be made to this embodiment, and other embodiments of the invention can be devised without departing from the spirit of the invention and the scope of the following claims. Accordingly, the claims should be interpreted broadly, and in accordance with the spirit of the invention, and not solely in accordance with that particular embodiment within which the invention has been taught.

What is claimed is:

1. A system to transfer liquid from a ship's tank containing liquid after rupture of the tank, the system comprising:

underpressure means for creating an underpressure less than atmospheric pressure in an ullage space of a ruptured tank of a ship, and for dynamically maintaining this underpressure so as to produce a balance in all forces acting on liquid contents of the ruptured tank, said balance of forces tending to preclude that the liquid contents of the tank should egress through the rupture;

conduit means, flow-connecting to the liquid of the ruptured tank at a level above a location of the rupture, for channeling under pressure forces a flow of the tank's liquid; and pump means, flow connected to the conduit means, for pumping with a suction force that is stronger than the underpressure the liquid from the ruptured tank through the conduit means;

wherein the underpressure means is operative to maintain the underpressure necessary to produce the balance of forces regardless that during the pumping of liquid by the pump means this necessary underpressure may change.

2. The system according to claim 1 wherein the conduit means comprises:

a main discharge pipe, extending between a position within the ruptured tank proximate to the tank's bottom and the pump means, for flow-connecting any liquid within the ruptured tank to the pump means;

a valve means, located in-line the main discharge pipe between the ruptured tank and the pump means, for gating any flow of liquid from the ruptured tank through the main discharge pipe; and a secondary discharge pipe, extending between the ruptured tank at a level above a location of the rupture and the pump means, also for flow-connecting the liquid within the ruptured tank to the pump means;

wherein at such times as the valve means precludes any flow of liquid from the ruptured tank through the main discharge pipe then liquid may still be evacuated from the ruptured tank from locations above the location of the rupture by pumping through the secondary discharge pipe.

3. The system according to claim 2 wherein the pump means comprises:

a main pump means, connected to the secondary discharge pipe and also to the main discharge pipe, for pumping liquid from the ruptured tank through the secondary discharge pipe, and also through the main discharge pipe at such times as flow therethrough is not cutoff by the valve means; and a secondary pump means, flow connected in-line the secondary discharge pipe, for pumping with a suction force that is stronger than the underpressure the liquid from the ruptured tank through the secondary discharge pipe;

wherein the secondary pump means is pumping the liquid through the secondary discharge pipe to the main pump means at times when the valve means precludes any transfer of liquid from the ruptured tank to the main pump means through the main discharge pipe.

4. The system according to claim 1 wherein said underpressure means comprises:

a gas pump.

5. The system according to claim 4 wherein the underpressure means further comprises:

a duct connecting the pump to the ullage space of the ship's ruptured tank.

6. The system according to claim 5 wherein the underpressure means further comprises:

an enclosure protecting an opening of the duct at the ruptured tank from any intrusion of the tank's liquid.

7. (Amended) The system according to claim 1 wherein the underpressure means comprises:

means for controlling gas flow from an ullage space of the ruptured tank.

8. The system according to claim 7 wherein the means for controlling gas flow comprises:

a valve; and a gas pump.

9. The system according to claim 5 wherein the valve comprises:

a motor for driving an open and shut condition of the valve.

10. The system according to claim 1 wherein the underpressure means further comprises:

means for monitoring the pressure less than atmospheric; and a vacuum sub-system comprising:

means for controllably creating the pressure less than atmospheric in the ruptured tank; and a computer responsive to the means for monitoring for controlling the vacuum sub-system to produce the pressure less than atmospheric pressure.

11. A system to reduce spillage of oil from a ruptured ship's tank, the system comprising:

inerting means for maintaining a gaseous mixture enhanced with inert gas in an ullage space above oil within a tank containing oil within a ship sufficient so as to reduce the flammability of hydrocarbon vapors and air in this ullage space;

underpressure means for maintaining a gaseous pressure within the ullage space at less than atmospheric pressure nonetheless that mixture of gases therein is enhanced in inert gas, and for thereafter maintaining a balance of pressure forces on the oil within the tank at the site of any rupture to the tank upon the occasion of the rupture so as to impede spillage of oil from the tank;

conduit means, flow-connecting to the oil of the ruptured tank at a level above a location of the rupture, for channeling a flow of the tank's oil; and pump means, flow connected to the conduit means, for pumping with a suction force that is stronger than the underpressure the oil from the ruptured tank through the conduit means.

12. The system according to claim 11 wherein the conduit means comprises:

a main discharge pipe, extending between a position within the ruptured tank proximate to the tank's bottom and the pump means, for flow-connecting any liquid within the ruptured tank to the pump means;

a valve means, located in-line the discharge pipe between the ruptured tank and the pump means, for gating any flow of liquid from the tank through the main discharge pipe; and a secondary discharge pipe, extending between the ruptured tank at a level above a location of the rupture and the pump means, also for flow-connecting the liquid within the ruptured tank to the pump means;

wherein at such times as the valve means precludes any flow of liquid from the ruptured tank through the main discharge pipe then liquid may still be evacuated from the ruptured tank above the location of the rupture by pumping through the secondary discharge pipe.

13. In a ship having a tank containing liquid, a main discharge pipe extending into the tank and through which the liquid contents of the tank may be evacuated by pumping, and a main pump means for pumping the liquid from the tank through the discharge pipe, a system to transfer the liquid from the ship's tank after its rupture, the system comprising:

underpressure means for creating an underpressure less than atmospheric pressure in an ullage space of a ruptured tank of a ship, and for dynamically maintaining this underpressure so as to produce a balance in all forces acting on liquid contents of the ruptured tank, said balance of forces tending to preclude that the liquid contents of the ruptured tank should egress through the rupture;

valve means, located on the discharge pipe between the ruptured tank's liquid and the main pump means, for shutting off any flow of liquid from the ruptured tank through the discharge pipe;

conduit means, flow-connecting to the liquid of the ruptured tank at a level above a location of the rupture, for channeling a flow of the ruptured tank's liquid; and suction pump means, flow connected to the conduit means, for pumping with a suction force that is stronger than the underpressure the liquid from the ruptured tank through the conduit means to the main pump means, therein to prime the main pump means with the ruptured tank's liquid.

14. A plumbing system to (i) maintain a gaseous underpressure in the ullage space of a ship's tank containing liquid at the same time that (ii) liquid is pumped from the same ship's tank after rupture of the tank, the ship's gaseous and liquid plumbing system comprising:

first gas conduit means for connecting an ullage space of a ship's tank to a gas pump means;

gas pump means, connected to the ullage space of the ship's tank by the first gas conduit means, for pumping gases from the ullage space of the ship's tank so as to create a gaseous underpressure less than atmospheric pressure in the ullage space of the ship's tank, and for dynamically maintaining this gaseous underpressure regardless of any rupture of the tank so as to produce a balance in all forces acting on liquid contents of the ruptured tank, said balance of forces tending to preclude that the liquid contents of the tank should egress through any rupture;

liquid conduit means for flow-connecting the liquid within the ruptured tank at a level above a location of the rupture to a liquid pump means; and liquid pump means, flow connected to the liquid within the ruptured tank by the liquid conduit means, for pumping with a suction force that is stronger than the force of the gaseous underpressure the liquid from the ruptured tank through the liquid conduit means.

15. The plumbing system according to claim 14 further comprising:

an inerting means for maintaining a gaseous mixture enhanced with inert gas in the ullage space; and a second gas conduit means for connecting the ullage space of the ship's tank to the inerting means.

16. The plumbing system according to claim 14 wherein the liquid conduit means comprises:

a main discharge pipe, extending between a position within the ruptured tank proximate to the tank's bottom and the liquid pump means, for flow-connecting the liquid within the ruptured tank to the pump means;

a valve means, located in-line the discharge pipe between the ruptured tank and the liquid pump means, for gating any flow of liquid from the ruptured tank through the main discharge pipe; and a secondary discharge pipe, extending between the ruptured tank at a level above a location of the rupture and the liquid pump means, also for flow-connecting the liquid within the ruptured tank to the liquid pump means;

wherein at such times as the valve means precludes any flow of liquid from the ruptured tank through the main discharge pipe then liquid may still be evacuated from the ruptured tank above the location of the rupture by pumping through the secondary discharge pipe.

17. A method of evacuating liquid from a ship's tank containing liquid after rupture of the tank, the method comprising:

creating a gaseous underpressure less than atmospheric pressure in an ullage space of a ruptured tank of a ship;

dynamically maintaining this gaseous underpressure so as to produce a balance of all forces acting on liquid contents of the ruptured tank, said balance of forces tending to preclude that the liquid contents of the ruptured tank should egress through the rupture;

flow-connecting the liquid of the ruptured tank at a level above a location of the rupture to a pump; and pumping with a suction force that is stronger than the force of the gaseous underpressure the liquid from the ruptured tank.

18. A system for the simultaneous control of a gaseous underpressure in the ullage space of a ruptured ship's tank containing liquid, and a suction force within a pipe flow-connecting to the liquid contents of the ruptured ship's tank, in order to evacuate the tank of liquid through the pipe while simultaneously inhibiting the spillage of liquid through the rupture, the system comprising:

underpressure means for dynamically maintaining a a gaseous underpressure less than atmospheric pressure in an ullage space of a ruptured tank of a ship so as to produce a balance of all forces acting on liquid contents of the ruptured tank, said balance of forces tending to preclude that the liquid contents of the ruptured tank should egress through the rupture;

pumping means for pumping with a suction force that is stronger than a force of the gaseous underpressure the liquid from the ruptured tank through a pipe flow-connecting to the liquid contents of the tank in order to evacuate the liquid content of the tank through the pipe.

* * * * *